US008465126B2

(12) United States Patent
Murase

(10) Patent No.: US 8,465,126 B2
(45) Date of Patent: Jun. 18, 2013

(54) LIQUID JET HEAD AND LIQUID JET APPARATUS

(75) Inventor: Tetsuya Murase, Chiba (JP)

(73) Assignee: SII Printek Inc. (JP)

( * ) Notice: Subject to any disclaimer, the term of this patent is extended or adjusted under 35 U.S.C. 154(b) by 198 days.

(21) Appl. No.: 12/928,262

(22) Filed: Dec. 7, 2010

(65) Prior Publication Data

US 2011/0148986 A1 Jun. 23, 2011

(30) Foreign Application Priority Data

Dec. 21, 2009 (JP) ..... 2009-289682

(51) Int. Cl.
*B41J 2/135* (2006.01)

(52) U.S. Cl.
USPC ..... 347/44; 347/43; 347/47; 347/54; 347/68; 347/92; 438/478; 29/890.1

(58) Field of Classification Search
None
See application file for complete search history.

(56) References Cited

U.S. PATENT DOCUMENTS

| | | | | |
|---|---|---|---|---|
| 5,774,145 | A * | 6/1998 | Morita et al. | 347/43 |
| 6,270,205 | B1 * | 8/2001 | Takata | 347/85 |
| 6,357,115 | B1 * | 3/2002 | Takatsuka et al. | 29/890.1 |
| 6,719,404 | B2 * | 4/2004 | Kobayashi | 347/54 |
| 6,955,427 | B2 * | 10/2005 | Takata | 347/92 |
| 7,401,905 | B2 * | 7/2008 | Ito et al. | 347/68 |
| 7,922,291 | B2 * | 4/2011 | Kubo et al. | 347/50 |

* cited by examiner

*Primary Examiner* — Matthew Luu
*Assistant Examiner* — John P Zimmermann
(74) *Attorney, Agent, or Firm* — Adams & Wilks

(57) ABSTRACT

A liquid jet head has an actuator with grooves arranged on a surface of a substrate. The actuator is configured to discharge liquid from nozzles communicating with respective ones of the grooves. A flow path member supplies the liquid to the grooves of the actuator. A damper member is provided between the actuator and the flow path member for coupling the actuator and the flow path member to each other. The damper member is bonded with an adhesive to each of the actuator and the flow path member.

20 Claims, 6 Drawing Sheets

LIQUID JET HEAD AND LIQUID JET APPARATUS

BACKGROUND OF THE INVENTION

1. Field of the Invention

The present invention relates to a liquid jet head for forming an image, a character, or a thin film material on a recording medium by discharging liquid from a nozzle, and to a liquid jet apparatus using the liquid jet head.

2. Description of the Related Art

In recent years, there has been used an ink jet type liquid jet head for discharging ink droplets on recording paper or the like to render a character or graphics or for discharging a liquid material on a surface of an element substrate to form a pattern of a functional thin film. In such a liquid jet head, ink or a liquid material is supplied from a liquid tank via a supply tube to the liquid jet head, the ink is caused to fill minute space formed in the liquid jet head, and the capacity of the minute space is momentarily reduced according to a drive signal to discharge a liquid droplet from a nozzle which communicates to a groove.

FIG. 7 is a sectional view illustrating an ink jet head 100 of this kind which is described in Japanese Patent Application Laid-open No. 2005-306022. The ink jet head 100 includes a substrate 101 formed of a piezoelectric material, for discharging ink in an ink chamber 103 which is formed on a surface thereof, a lid member 102 placed on the surface of the substrate 101 so as to expose a part of the ink chamber 103, a manifold 105 placed on a surface of the lid member 102 and on the surface of the substrate 101, for supplying ink which flows in from an in-between tube 106 to the ink chamber 103, and a cover 108 for housing those members.

Drive power is applied from a flexible printed circuit board (FPC) 107 to an electrode (not shown) on the substrate 101 to change the capacity of the ink chamber 103 by the piezoelectric effect. Then, a liquid droplet D is jetted from a nozzle in a nozzle plate 104 to perform recording on a recording medium with the ink. By moving the ink jet head 100 or the recording medium in synchronization with the jetting of the liquid droplet, a character or graphics may be printed.

A surface of the lid member 102 is bonded to the surface of the substrate 101. The substrate 101 is formed of a piezoelectric material, for example, PZT ceramic. In order to prevent warpage of the substrate 101 due to temperature change, the lid member 102 and the substrate 101 are formed of a same material. The manifold 105 and the lid member 102 are bonded at a bonding portion A1 while the manifold 105 and the substrate 101 are bonded at a bonding portion A2. As the material of the manifold 105, from the viewpoint of weight reduction and cost reduction, a synthetic resin such as an acrylic resin, a polyimide resin, or a polycarbonate resin, or a metallic material is generally used. Therefore, bonding between different kinds of materials is carried out at the bonding portions A1 and A2. In order to prevent warpage of the substrate 101 and to prevent peeling off of the manifold 105 from the substrate 101 or the lid member 102, it is necessary to select materials of the manifold 105 and the substrate 101 so that the difference in the thermal expansion coefficient between the manifold 105 and the substrate 101 is small. Therefore, materials which may be used for the manifold 105 are limited.

Further, the bonding portions A1 and A2 are in direct contact with ink which flows through the ink chamber 103. An adhesive which is low in hardness and soft even after it hardens is generally liable to be dissolved in organic ink. Therefore, an adhesive which is required to be resistant to ink is high in hardness and adhesive strength thereof is high. On the other hand, in such an ink jet system, ink is discharged by momentarily reducing the capacity of the ink chamber 103 by the piezoelectric effect. However, ink discharge speed is affected by the characteristic frequency of the substrate 101. The ink jet head discharges ink while the ink jet head moves, and thus, change in the ink discharge speed results in displacement of the landing position of the ink.

In particular, when the hardness of the adhesive which is applied to the bonding portions A1 and A2 is high, vibrations of the substrate 101 and the lid member 102 caused by discharge of ink are propagated via the adhesive to the manifold 105 and other members for fixing the manifold 105. Then, the vibrations of the substrate 101 caused by discharge of ink is affected by other members to change the discharge speed of liquid droplets to be discharged. Therefore, there is a problem in that, depending on the drive frequency and conditions of the discharge of liquid droplets, the discharge speed varies and a liquid droplet of a target amount may not be caused to land on a target position.

Further, the surfaces of the substrate 101 and the lid member 102 to be bonded are ordinarily not flat. Therefore, thickness of an adhesive on those surfaces to be bonded varies depending on the place. Variations in the thickness of the adhesive at the bonding portions A1 and A2 affect the drive performance. Further, the adhesive used at the bonding portions A1 and A2 swells when brought into contact with ink, in particular, organic ink. When the adhesive is brought into contact with ink and swells, the thickness and the hardness of the adhesive change, and thus, there is a problem in that warpage of the substrate 101 may occur and the substrate 101 may be broken.

SUMMARY OF THE INVENTION

The present invention has been made in view of the above, and an object of the present invention is to provide a liquid jet head in which liquid discharge speed is less liable to be affected by surrounding members connected to a piezoelectric substrate, and to provide a liquid recording apparatus using the liquid jet head.

A liquid jet head according to the present invention includes: an actuator having a plurality of long grooves arranged on a surface of a substrate, the actuator being for discharging liquid from nozzles which communicate to the plurality of long grooves, respectively; a flow path member for supplying the liquid to the plurality of long grooves of the actuator; and a first damper member provided between the actuator and the flow path member, for coupling the actuator and the flow path member to each other.

Further, in the liquid jet head according to the present invention, the damper member is a rubber member or an elastomer member.

Further, the liquid jet head according to the present invention further includes: a base member for supporting the actuator; and a second damper member provided between the base member and the actuator, for coupling the base member and the actuator to each other.

Further, in the liquid jet head according to the present invention, the actuator has a structure in which a first actuator and a second actuator are stacked, and the liquid jet head further includes a third damper member provided between the first actuator and the second actuator, for coupling the first actuator and the second actuator to each other.

Further, in the liquid jet head according to the present invention, the third damper member is provided between a rear surface of a substrate of the first actuator and a rear surface of a substrate of the second actuator.

Further, in the liquid jet head according to the present invention, the actuator includes a cover plate stacked on the surface of the substrate so as to block openings of the plurality of long grooves except for a part of the plurality of long grooves, and the third damper member is provided between a rear surface of a substrate of the first actuator and a cover plate of the second actuator.

Further, in the liquid jet head according to the present invention, the damper member has an average thickness of 0.2 mm to 2.0 mm.

Further, in the liquid jet head according to the present invention, the damper member is resistant to a solvent.

Further, in the liquid jet head according to the present invention, the damper member is resistant to oil.

A liquid jet apparatus according to the present invention includes: the liquid jet head described above; a moving mechanism for reciprocating the liquid jet head; a liquid supply tube for supplying liquid to the liquid jet head; and a liquid tank for supplying the liquid to the liquid supply tube.

In the liquid jet head according to the present invention, the damper member is provided between the actuator having the plurality of long grooves arranged on the front surface of the substrate, the actuator being for discharging liquid from nozzles which communicate to the plurality of long grooves, respectively, and the flow path member for supplying the liquid to the plurality of long grooves of the actuator. This prevents vibrations of the actuator caused by discharge of liquid from being affected by the flow path member and other members for supporting the flow path member, and thus, variations in the liquid discharge speed are reduced, distortion due to the difference in the thermal expansion coefficient between the actuator and the flow path member or due to stress caused by unevenness of the surfaces to be bonded decreases, and a highly reliable liquid jet head and a highly reliable liquid jet apparatus may be provided with smaller variations in the discharge characteristics.

DETAILED DESCRIPTION OF THE PREFERRED EMBODIMENTS

Figure 1A:
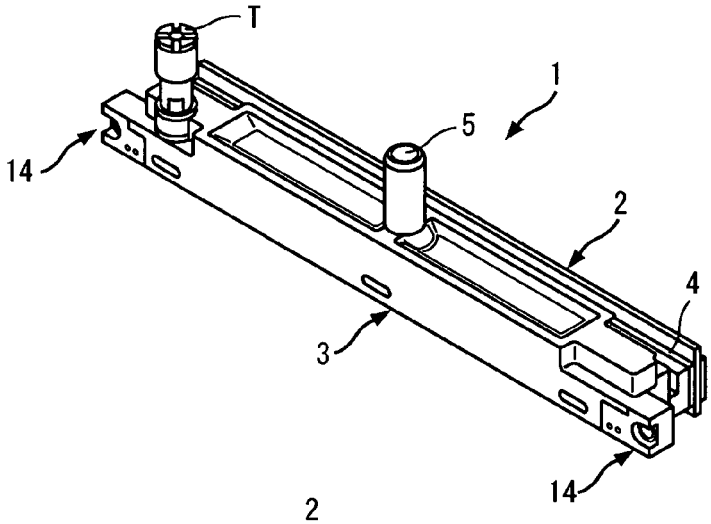
FIGS. 1A to 1C are explanatory views of a liquid jet head according to a first embodiment of the present invention.

In a liquid jet head according to the present invention, a damper member is provided between an actuator having a plurality of long grooves arranged in a surface thereof, the actuator being for discharging liquid from nozzles which communicate to the long grooves, respectively, and a flow path member for supplying liquid to the plurality of grooves of the actuator, and the actuator and the flow path member are coupled to each other via the damper member.

As the damper member, a material which is lower in hardness than those of a substrate forming the actuator and of the flow path member coupled to the actuator may be used, including a rubber member and an elastomer member. More specifically, a polyethylene rubber material or a polypyrene rubber material may be used. It is preferred that the damper member be resistant to a solvent or to oil, for example, to ink containing an organic solvent. The material of the damper member has a swelling coefficient of 20% or less, preferably 5% to 10%, with respect to ink containing an organic solvent. The flow path member and the damper member, and the damper member and the actuator may be coupled to each other using an adhesive. The adhesive used here may be resistant to ink and may be high in hardness.

The damper member is provided between the actuator and the flow path member as described above, and thus, a shock wave generated when the actuator discharges a liquid droplet is less liable to be propagated to the flow path member and other members connected to the flow path member. Therefore, when the actuator is driven, the actuator is not affected by the flow path member and other members connected to the flow path member, and thus, variations in liquid droplet jet speed as the frequency of a drive signal changes become smaller, and the place at which a liquid droplet performs recording and the amount of a liquid droplet may be controlled with high precision. It is preferred that the damper member have an average thickness of 0.2 mm to 2.0 mm. When the size is in this range, the damping function may be maintained and still the liquid jet head is not required to be larger.

Further, even if there is a difference in the temperature coefficient between the substrate of the actuator and the flow path member, and the amounts of expansion or contraction of the substrate and of the flow path member are different from each other when the temperature changes, the damper member alleviates the difference in the amount of expansion or contraction, and thus, stress applied to the actuator may be reduced. Further, even if the surfaces to be bonded of the actuator and the flow path member are uneven, the damper member is provided therebetween, and thus, variations in the thickness of the adhesive are reduced and lowering of the adhesive strength and occurrence of uneven stress due to variations in the thickness may be prevented.

Further, a second damper member may be provided between a base member for supporting the actuator and the actuator. With this, the actuator is supported via the damper member, and thus, vibrations of the actuator is less liable to be propagated to other members, and, as a result, a shock wave generated when a liquid droplet is discharged is less liable to be affected by the outside, and thus, jetting characteristics of a liquid droplet may be stabilized.

Further, when a first actuator and a second actuator are stacked, a third damper member may be provided between the first and second actuators. The first damper member may be provided between the first actuator and the flow path member connected thereto and the second damper member may be provided between the second actuator and the base member connected thereto.

The structure makes it possible to drive each of the first and second actuators without being affected by vibrations of other actuators and other members. As a result, the jet speed and the amount of a liquid droplet jetted from the first and the second actuators may be made even. The present invention is now described in detail in the following with reference to the attached drawings.

(First Embodiment)

Figure 1B:
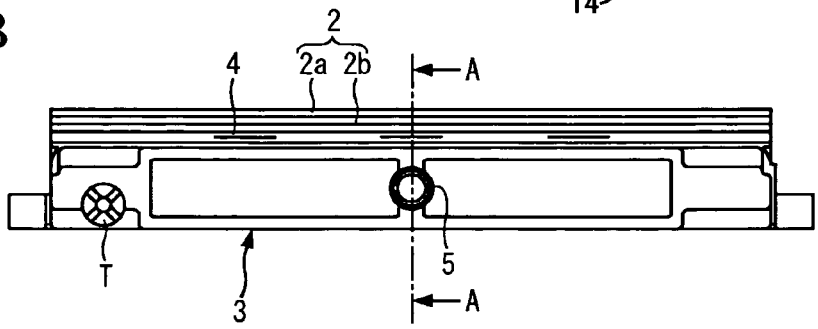
Figure 1C:
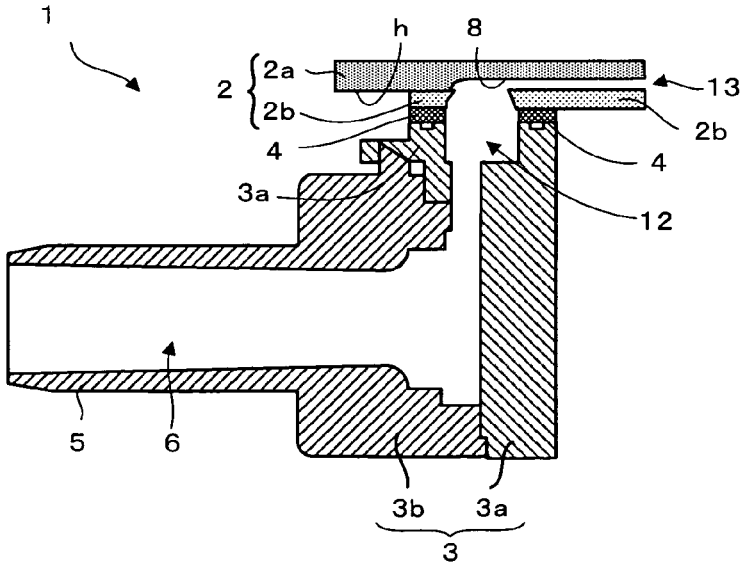

FIGS. 1A to 1C are explanatory views of a liquid jet head 1 according to a first embodiment of the present invention. FIG. 1A is a perspective view of the liquid jet head 1, FIG. 1B is a top view of the liquid jet head 1, and FIG. 1C is a schematic longitudinal sectional view taken along the line A-A of FIG. 1B.

As illustrated in FIGS. 1A to 1C, the liquid jet head 1 includes an actuator 2, a flow path member 3, and a damper member 4. The damper member 4 is provided between the actuator 2 and the flow path member 3 and couples the actuator 2 and the flow path member 3 to each other. The actuator 2 and the damper member 4 are bonded together and the damper member 4 and the flow path member 3 are bonded together both using an adhesive. As the damper member 4, for example, a rubber member or an elastomer member is used. As the adhesive, an epoxy adhesive is used.

The actuator 2 includes a substrate 2*a* formed of a piezoelectric body and a cover plate 2*b* bonded thereon. The substrate 2*a* includes a plurality of grooves 8 formed in a front surface h thereof so as to be side by side in a direction perpendicular to the plane of the drawing. The grooves 8 are partitioned by side walls formed of a piezoelectric body, and electrodes (not shown) are formed on the side walls. The cover plate 2*b* covers the front surface h of the substrate 2*a* so as to expose open ends of the long grooves 8 and so as to block other openings. As illustrated in FIG. 10, a left end of the substrate 2*a* protrudes from a left end of the cover plate 2*b*. Terminal electrodes (not shown) which are electrically connected to the electrodes formed on the side walls of the respective grooves 8 are formed on the front surface h of the protruding portion. A right end surface of the substrate 2*a* and a right end surface of the cover plate 2*b* are flush with each other. The grooves 8 are open at the right end surface (openings for nozzle 13) and communicate to nozzles, respectively, in a nozzle plate (not shown). When a drive signal is applied to a terminal electrode formed on the front surface h of the substrate 2*a*, a corresponding side wall is deformed to change the capacity of a corresponding groove 8. The change in the capacity is used to discharge liquid, which fills the groove 8, from a corresponding opening for nozzle 13 at the right end surface.

The flow path member 3 includes a first flow path member 3*a* and a second flow path member 3*b* connected to the first flow path member 3*a*. The flow path member 3 includes mounting portions 14 at both ends thereof and a knob T on a top surface thereof. The liquid jet head 1 is fixed by fastening the mounting portions 14 with screws. The knob T is provided for maintenance.

The first flow path member 3*a* is coupled to the actuator 2 via the damper member 4. The first flow path member 3*a* and the second flow path member 3*b* includes a flow path 6 formed therein to pass therethrough. The first flow path member 3*a* includes a liquid supply chamber 12 for supplying liquid to the plurality of grooves 8 of the actuator 2. The second flow path member 3*b* includes a connecting portion 5 for letting liquid flow in. Liquid which flows in the connecting portion 5 passes through the flow path 6 in the second flow path member 3*b* and the first flow path member 3*a* and through the liquid supply chamber 12 to flow in the plurality of grooves 8. The flow path in the first flow path member 3*a* and the flow path in the second flow path member 3*b* form an angle of 90°. As illustrated in FIG. 1A, the connecting portion 5 is placed on a top surface of the flow path member 3 and the flow path is bent into the 90° angle, thereby making thinner the liquid jet head 1 in a direction perpendicular to the front surface h of the substrate 2*a*.

As the material of the substrate 2*a* and the cover plate 2*b*, a piezoelectric body such as PZT may be used. By forming the substrate 2*a* and the cover plate 2*b* of a same material, warpage due to a difference in the thermal expansion coefficient may be prevented. As the material of the flow path member 3, a synthetic resin such as a polyimide resin, a high-density polyethylene (HDPE) resin, a polyacetal (POM) resin, or a polyphenylene sulfide (PPS) resin may be used.

As described above, the damper member 4 is provided between the actuator 2 and the first flow path member 3*a*, and thus, a shock wave generated when the actuator 2 discharges a liquid droplet is less liable to be propagated to the first flow path member 3*a* and the second flow path member 3*b*. In other words, when the actuator 2 is driven, the actuator 2 is less liable to be affected by the first flow path member 3*a* and the second flow path member 3*b*. Therefore, variations in liquid droplet discharge speed becomes smaller, and the place at which a liquid droplet performs recording and the amount of a liquid droplet may be controlled with high precision. Further, distortion due to the difference in the thermal expansion coefficient between the actuator 2 and the flow path member 3 or due to stress caused by unevenness of the surfaces to be bonded decreases, and thus, variations in the discharge characteristics of the actuator 2 may be reduced and the reliability may be improved.

(Second Embodiment)

Figure 2A:
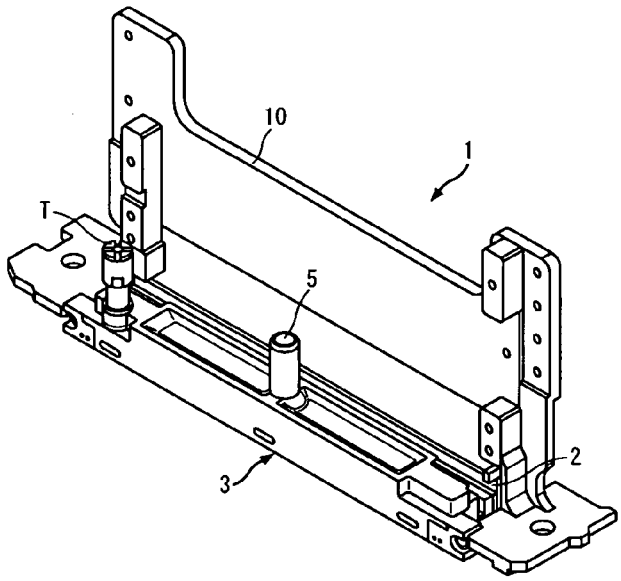
FIGS. 2A to 2C are explanatory views of a liquid jet head according to a second embodiment of the present invention.
Figure 2B:
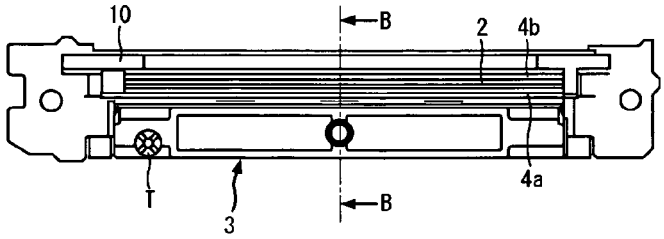
Figure 2C:
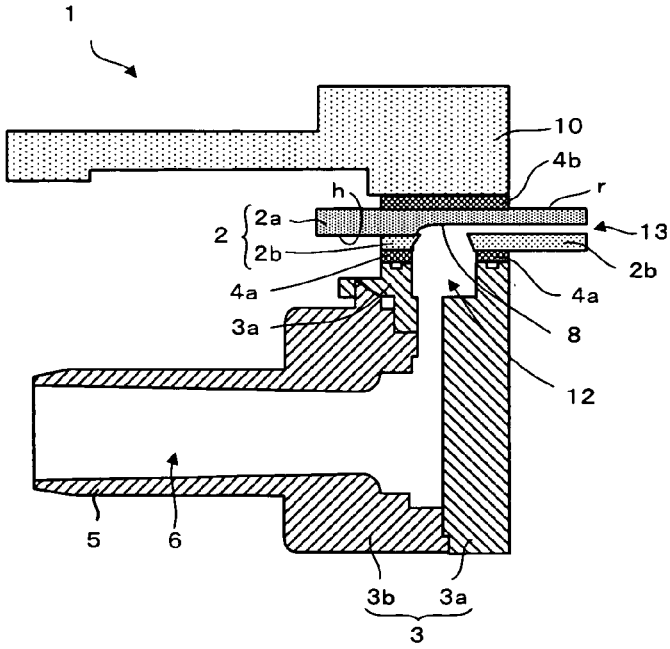

FIGS. 2A to 2C are explanatory views of the liquid jet head 1 according to a second embodiment of the present invention. FIG. 2A is a perspective view of the liquid jet head 1, FIG. 2B is a top view of the liquid jet head 1, and FIG. 2C is a schematic longitudinal sectional view taken along the line B-B of FIG. 2B. The second embodiment is different from the first embodiment in that the liquid jet head 1 is fixed to a base member 10 via a second damper member 4*b*. Therefore, in the following, what is different from the case of the first embodiment is mainly described and description of what is the same as in the first embodiment is omitted. Further, like reference symbols are used to designate like members or members having like functions.

As illustrated in FIGS. 2A to 2C, the liquid jet head 1 includes a laminate in which a first damper member 4*a* is provided and coupled between the actuator 2 and the flow path member 3, the base member 10, and the second damper member 4*b* provided between a rear surface r of a substrate 2*a* of the laminate and the base member 10. The substrate 2*a* and the second damper member 4*b* are bonded together and the base member 10 and the second damper member 4*b* are bonded together both using an adhesive. By directly fixing the actuator 2 by bonding the actuator 2 to the base member 10, the actuator 2 may be positioned with high precision. Note that, the first damper member 4*a* and the second damper member 4*b* are formed of a same material. Further, as the material of the base member 10, a synthetic resin, a metal, or the like may be used. Other structures are the same as those in the first embodiment.

As described above, the actuator 2 is directly fixed to the base member 10 via the second damper member 4*b*, and thus, the actuator 2 may be positioned without fail and with high precision. Further, vibrations of the actuator 2 caused by discharge of liquid are less liable to be propagated to the flow path member 3 and the base member 10. Therefore, variations in liquid droplet discharge speed may be reduced without being affected by the characteristic frequencies of the flow path member 3 and the base member 10. Further, distortion due to the difference in the thermal expansion coefficient between the actuator 2 and the base member 10 or due to stress caused by unevenness of the surfaces to be bonded is reduced by providing the first damper member 4*a* and the second damper member 4*b*, and, as a result, variations in the discharge characteristics of the actuator 2 may be reduced and the reliability may be improved.

(Third Embodiment)

Figure 3:
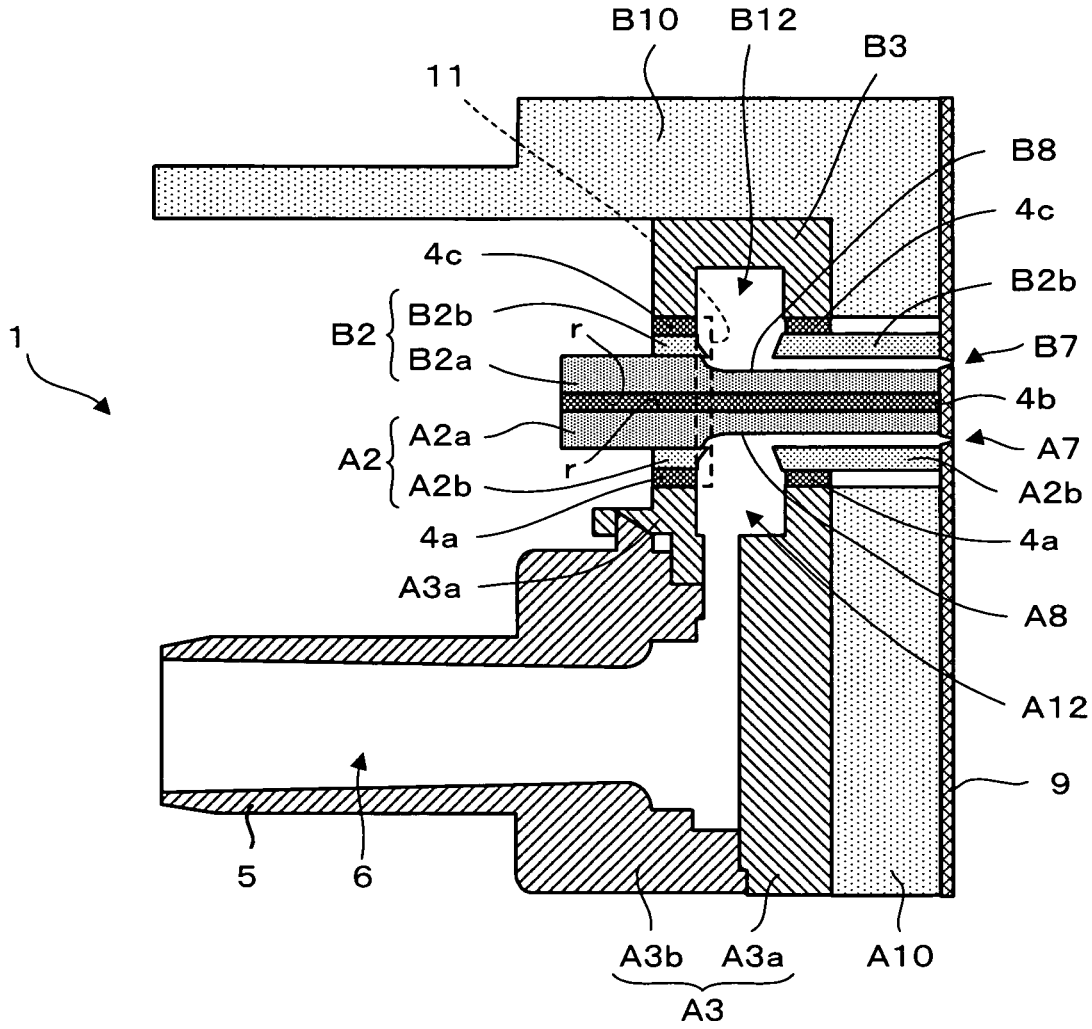
FIG. 3 is a schematic longitudinal sectional view of a liquid jet head according to a third embodiment of the present invention.

FIG. 3 is a schematic longitudinal sectional view of a liquid jet head 1 according to a third embodiment of the present invention. In this embodiment, a first actuator A2 and a second actuator B2 are bonded together.

As illustrated in FIG. 3, the first actuator A2 includes a substrate A2*a* having long grooves A8 formed in a surface thereof and a cover plate A2*b* bonded to the substrate A2*a* so as to cover the grooves A8 except one ends thereof. Similarly to the first actuator A2, the second actuator B2 includes a substrate B2*a* having long grooves B8 formed in a surface thereof and a cover plate B2*b* bonded to the substrate B2*a* so as to cover the grooves B8 except one ends thereof. A rear surface r of the first actuator A2 and a rear surface r of the second actuator B2, which are opposite to a cover plate side of the substrate A2*a* and a cover plate side of the substrate B2*a*, respectively, are opposed to each other, and are coupled to each other with a second damper member 4*b* provided therebetween. The rear surface r of the substrate A2*a* and a surface of the second damper member 4*b* are bonded together and the rear surface r of the substrate B2*a* and the other surface of the second damper member 4*b* are bonded together both using an adhesive.

An end surface of a liquid discharge side of the first actuator A2 and an end surface of the liquid discharge side of the second actuator B2 are flush with each other, and are bonded to a nozzle plate 9. The nozzle plate 9 includes nozzles A7 and B7 at places corresponding to the grooves A8 and B8, respectively.

The first actuator A2 is coupled to a flow path member A3 via the first damper member 4*a*. The flow path member A3 includes, similarly to the case of the first embodiment, a first flow path member A3*a* and a second flow path member A3*b* connected thereto. The second flow path member A3*b* includes the connecting portion 5 for letting liquid flow in, and liquid which flows in the connecting portion 5 may be supplied to the grooves A8 of the first actuator A2 through a flow path 6 formed in the flow path member A3. Further, the first flow path member A3*a* includes a liquid supply chamber A12 which communicates to an opening in the cover plate A2*b*. A base member A10 is placed between the flow path member A3 and the nozzle plate 9. The base member A10 and the first flow path member A3*a* are bonded together and the base member A10 and the nozzle plate 9 are bonded together both using an adhesive.

The second actuator B2 is coupled to a flow path member B3 via a third damper member 4*c*. The cover plate B2*b* and the third damper member 4*c* are bonded together and the flow path member B3 and the third damper member 4*c* are bonded together both using an adhesive. The flow path member B3 includes a liquid supply chamber B12 which corresponds to an opening in the cover plate B2*b*. The liquid supply chamber A12 of the flow path member A3 and the liquid supply chamber B12 of the flow path member B3 communicate to each other via a through hole 11 which passes through the first actuator A2 and the second actuator B2. More specifically, liquid which is supplied to the connecting portion 5 passes through the flow path 6 in the flow path member A3 to flow into the liquid supply chamber A12. A part of the liquid flows into the grooves A8 of the first actuator A2 while another part of the liquid passes through the through hole 11 to flow into the liquid supply chamber B12 and then into the grooves B8 of the second actuator B2.

The flow path member B3 is fixed to a base member B10 via an adhesive (not shown). The base member B10 is placed also between the flow path member B3 and the nozzle plate 9. The nozzle plate 9 and the base member B10 are fixed to each other using an adhesive. Note that, as the material of the nozzle plate 9, for example, a thin polyimide resin may be used. In this case, the nozzle plate 9 itself is flexible. Therefore, vibrations of the first actuator A2 are not propagated to the second actuator B2 and the base member A10 via the nozzle plate 9. Further, vibrations of the second actuator B2 are not propagated to the first actuator A2 and the base member B10 via the nozzle plate 9.

Note that, the structure described above is only an embodiment of the present invention and the present invention is not limited thereto. For example, the second flow path member B3 may be placed on an end side in a direction perpendicular to the long grooves A8 and the long grooves B8 formed in the substrate A2*a* and the substrate B2*a*, respectively. By causing liquid to be supplied to the liquid supply chambers A12 and B12 of the flow path members A3 and B3, respectively, little by little from the end side thereof, the liquid jet head 1 may be made further thinner.

With the structure described above, vibrations of the first actuator A2 and the second actuator B2 are less liable to be propagated to other members adjacent thereto. Therefore, vibrations of the actuators A2 and B2 are not affected by the characteristic frequencies of the flow path members A3 and B3 and the base members A10 and B10, and variations in the liquid droplet discharge speed are reduced. Further, distortion due to the difference in the thermal expansion coefficients between the actuators A2 and B2 and the base members A10 and B10, respectively, or due to stress caused by unevenness of the surfaces to be bonded is reduced by providing the second damper member 4*b* and the third damper member 4*c*, and, as a result, variations in the discharge characteristics of the actuators may be reduced and the reliability may be improved.

(Result of Comparison of Liquid Droplet Discharge Speed)

Figure 4A:
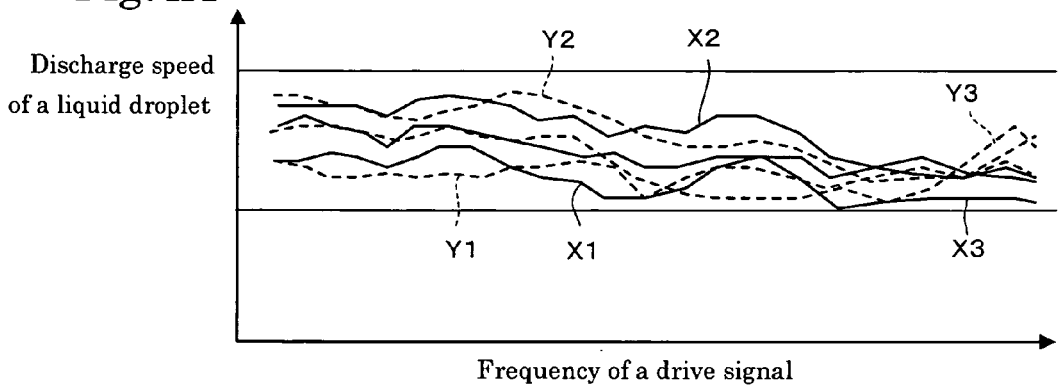
FIGS. 4A and 4B are graphs showing variations in liquid jet speed of the liquid jet head according to the present invention.
Figure 4B:
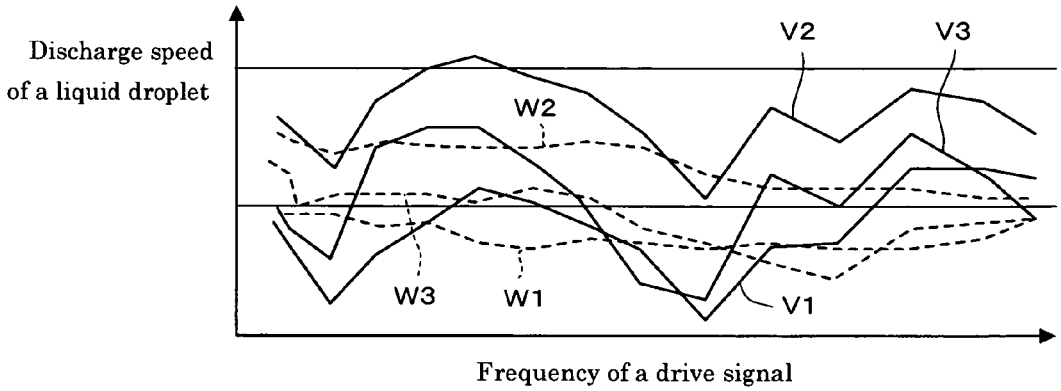

FIGS. 4A and 4B are graphs showing the relationship between the frequency of a drive signal and the discharge speed of a liquid droplet discharged from a nozzle 7. FIG. 4A shows the result of measurement with the liquid jet head 1 according to the third embodiment. FIG. 4B shows the result of measurement with a comparative liquid jet head in which the first damper member 4*a*, the second damper member 4*b*, and the third damper member 4*c* are omitted and members are bonded together using an adhesive the rigidity of which after hardened is relatively low for comparison purposes. The horizontal axis in each figure represents the frequency of a drive signal applied to the actuator 2, and the frequency becomes higher in the direction of an arrow. The vertical axis in each figure represents the discharge speed of a liquid droplet discharged from a nozzle of the actuator 2, and the speed becomes higher in the direction of the arrow. FIG. 4A and FIG. 4B are drawn to scale.

Plots X1 to X3 of FIG. 4A show discharge characteristics of the first actuator A2 while plots Y1 to Y3 show discharge characteristics of the second actuator B2. The plots X1 and Y1 show discharge characteristics when one liquid droplet is discharged from a nozzle 7. The plots X2 and Y2 show discharge characteristics when two liquid droplets are successively discharged from a nozzle 7, which join together before landing on a recording medium. The plots X3 and Y3 show discharge characteristics when three liquid droplets are successively discharged from a nozzle 7, which join together before landing on a recording medium.

In FIG. 4B for comparison purposes, plots V1 to V3 show discharge characteristics of the first actuator A2 while plots W1 to W3 show discharge characteristics of the second actuator B2. The plots V1 and W1 show discharge characteristics when one liquid droplet is discharged from a nozzle. The plots V2 and W2 show discharge characteristics when two liquid droplets are successively discharged from a nozzle, which join together before landing on a recording medium. The plots V3 and W3 show discharge characteristics when three liquid droplets are successively discharged from a nozzle, which join together before landing on a recording medium.

First, with regard to the first actuator A2, the plots X1 to X3 of the liquid jet head 1 according to the present invention which uses the damper member 4 are compared with the plots V1 to V3 of the comparative liquid jet head which does not use the damper member 4. Then, variations in the discharge speed when the drive frequency changes are greater in the comparative liquid jet head than in the liquid jet head 1 according to the present invention, and the range of variations in the discharge speed when the number of the liquid droplets changes from one to three is wider in the comparative liquid jet head than in the liquid jet head 1 according to the present invention. The range of variations in the discharge speed when the number of the liquid droplets changes from one to three according to the present invention is about ½ of that in the comparative example. There is a tendency with regard to the second actuator B2, which is similar to the case of the above-mentioned first actuator A2.

Further, with regard to the difference in the discharge speed between the first actuator A2 and the second actuator B2, in the comparative liquid jet head, the difference in the discharge speed between the first actuator A2 and the second actuator B2 is large at predetermined frequencies, while, in the liquid jet head 1 according to the present invention, the difference in the discharge speed between the first actuator A2 and the second actuator B2 is almost the same over a wide range of frequencies.

Further, in the liquid jet head 1 according to the present invention, with regard to all the discharge conditions that the number of the liquid droplets is one to three in the first actuator A2 and the second actuator B2, there is a frequency band in which the variations in the discharge speed are smaller, while, in the comparative liquid jet head, the variations are large as a whole and the discharge speed does not converge.

More specifically, in the liquid jet head 1 according to the present invention, the variations in the discharge speed are small in a wide frequency band, and thus, the liquid jet head 1 according to the present invention may be applied easily to liquid jet apparatus of various recording speeds and discharge conditions. The difference in the discharge speed is small with regard to all the discharge conditions that the number of the liquid droplets is one to three, and thus, the place and the density of liquid which performs recording on a recording medium may be controlled with high precision. Further, even if the actuator 2 is multilayered, the difference in the discharge speed is small between the actuators 2, and thus, recording may be performed on a recording medium at high speed, at high density, and with high precision.

(Fourth Embodiment)

Figure 5:
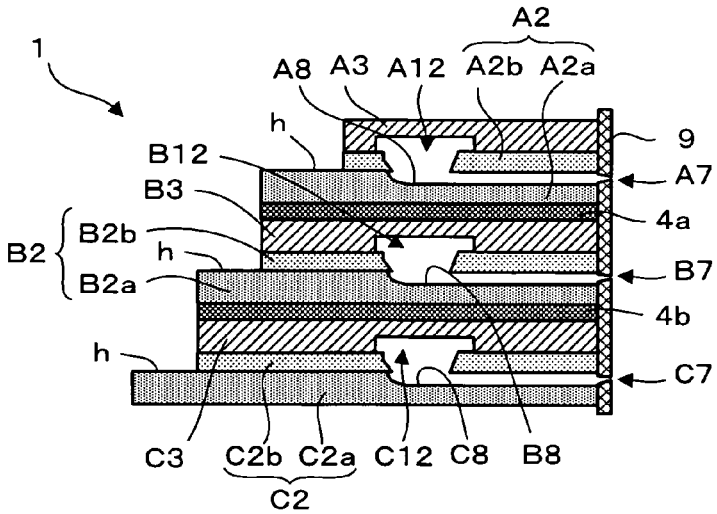
FIG. 5 is a schematic longitudinal sectional view of a liquid jet head according to a fourth embodiment of the present invention.

FIG. 5 is a schematic longitudinal sectional view of a liquid jet head 1 according to a fourth embodiment of the present invention. In the fourth embodiment, three actuators are stacked.

A first actuator A2 includes a substrate A2*a* having long grooves A8 in a front surface h thereof and a cover plate A2*b* bonded to the front surface h. A flow path member A3 including a liquid supply chamber A12 is placed on a surface of the cover plate A2*b* which is opposite to the substrate A2*a* side. An end surface of a liquid discharge side of the substrate A2*a*, an end surface of the liquid discharge side of the cover plate A2*b*, and an end surface of the liquid discharge side of the flow path member A3 are flush with one another, and a nozzle plate 9 is placed on the end faces under a state in which nozzles A7 communicate to grooves A8, respectively.

A second actuator B2 includes a substrate B2*a* having long grooves B8 in a front surface h thereof and a cover plate B2*b* bonded to the front surface h. A flow path member B3 including a liquid supply chamber B12 is placed on a surface of the cover plate B2*b* which is opposite to the substrate B2*a* side. The first actuator A2 is placed on a surface of the flow path member B3 which is opposite to the second actuator B2 side via a first damper member 4*a*. An end surface of the liquid discharge side of the substrate B2*a*, an end surface of the liquid discharge side of the cover plate B2*b*, and an end surface of the liquid discharge side of the flow path member B3 are flush with one another, and the nozzle plate 9 is bonded to the end faces under a state in which nozzles B7 communicate to grooves B8, respectively. The flow path member B3 and the first damper member 4*a* are bonded together and the substrate A2*a* and the first damper member 4*a* are bonded together both using an adhesive.

A third actuator C2 includes a substrate C2*a* having long grooves C8 in the front surface h thereof and a cover plate C2*b* bonded to the front surface h. A flow path member C3 including a liquid supply chamber C12 is placed on a surface of the cover plate C2*b* which is opposite to the substrate C2*a* side. The second actuator B2 is placed on a surface of the flow path member C3 which is opposite to the third actuator C2 side via a second damper member 4*b*. An end surface of the liquid discharge side of the substrate C2*a*, an end surface of the liquid discharge side of the cover plate C2*b*, and an end surface of the liquid discharge side of the flow path member C3 are flush with one another, and the nozzle plate 9 is bonded to the end faces under a state in which nozzles C7 communicate to grooves C8, respectively. The flow path member C3 and the second damper member 4*b* are bonded together and the substrate B2*a* and the second damper member 4*b* are bonded together both using an adhesive.

Ends of the actuators A2, B2, and C2 opposite to the nozzle side (hereinafter, referred to as other ends) are in the shape of stairs. More specifically, the other end of the substrate A2*a* of the first actuator A2 protrudes from the other ends of the cover plate A2*b* and the flow path member A3. Similarly, the other end of the substrate B2*a* of the second actuator B2 protrudes from the other ends of the cover plate B2*b*, the flow path member B3, and the substrate A2*a*. Further, the other end of the substrate C2*a* of the third actuator C2 protrudes from the other ends of the cover plate C2*b*, the flow path member C3, and the substrate B2*a*.

The shape is like stairs and the surfaces h of the substrates A2*a*, B2*a*, and C2*a* are exposed on upper surfaces of the steps of the stairs, respectively, and thus, an FPC board may be bonded to the substrates A2*a*, B2*a*, and C2*a* for easy connection to an external circuit. Further, the liquid supply chambers A12, B12, and C12 of the flow path members A3, B3, and C3 may communicate to one another via through holes provided therein, or liquid may be split into the liquid supply chambers A12, B12, and C12 by providing a common liquid supply portion at an end in a direction perpendicular to the plane of the drawing.

With the structure described above, vibrations of each of the first, second, and third actuators A2, B2, and C2 are less liable to be propagated to other actuators adjacent thereto. Further, by forming the nozzle plate 9 of a flexible member, vibrations are prevented from being propagated via the nozzle plate 9. Therefore, variations in the discharge speed of liquid droplets discharged from the actuators A2, B2, and C2 are reduced, and recording may be performed on a recording medium with high precision and at high density.

Note that, in the fourth embodiment, a structure in which three actuators are stacked is described, but the present invention is not limited thereto. More than three actuators may be stacked, and also in this case, a damper member may be provided between the actuators. Further, as in the first embodiment and the second embodiment, a damper member may be provided between a multi-layered actuator and a base member holding the multi-layered actuator and between a multi-layered actuator and another flow path member.

Further, in the fourth embodiment, three actuators are stacked and, as described above, the other ends of the actuators are formed in the shape of stairs, but the present invention is not limited thereto. More specifically, it may be that the other ends are not formed in the shape of stairs and the first, second, and third actuators A2, B2, and C2 are formed in a same size and are bonded together similarly to the case of the fourth embodiment.

(Fifth Embodiment)

Figure 6:
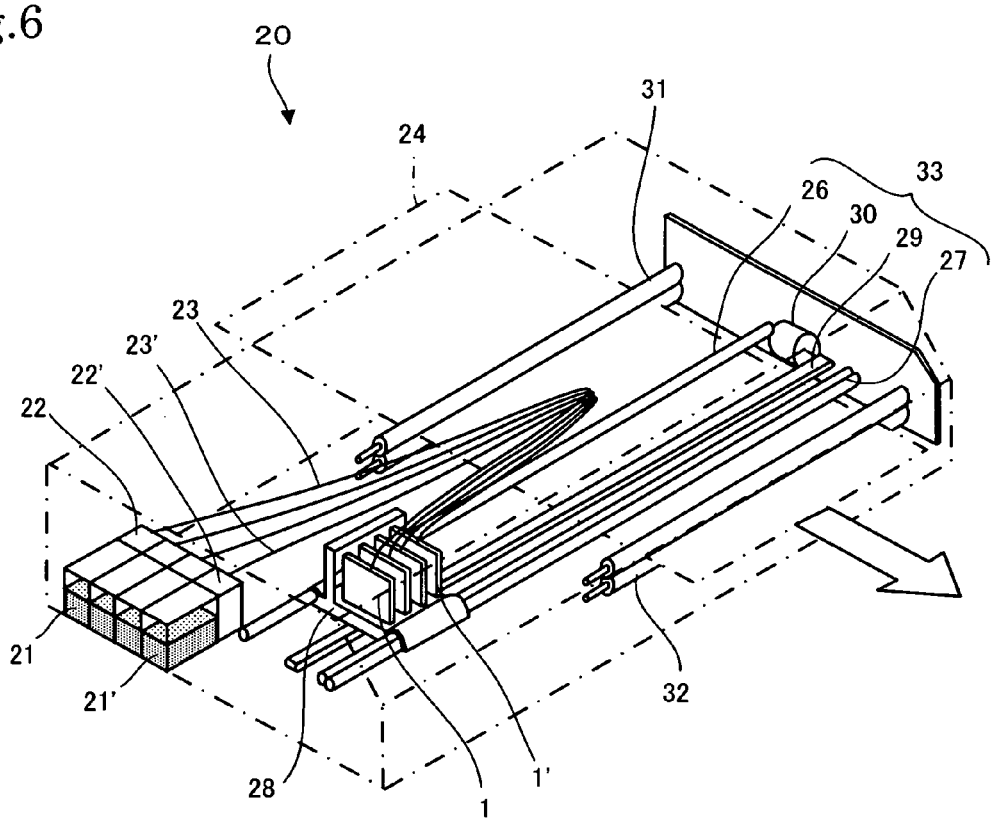
FIG. 6 is a schematic perspective view of a liquid jet apparatus according to a fifth embodiment of the present invention.
Figure 7:
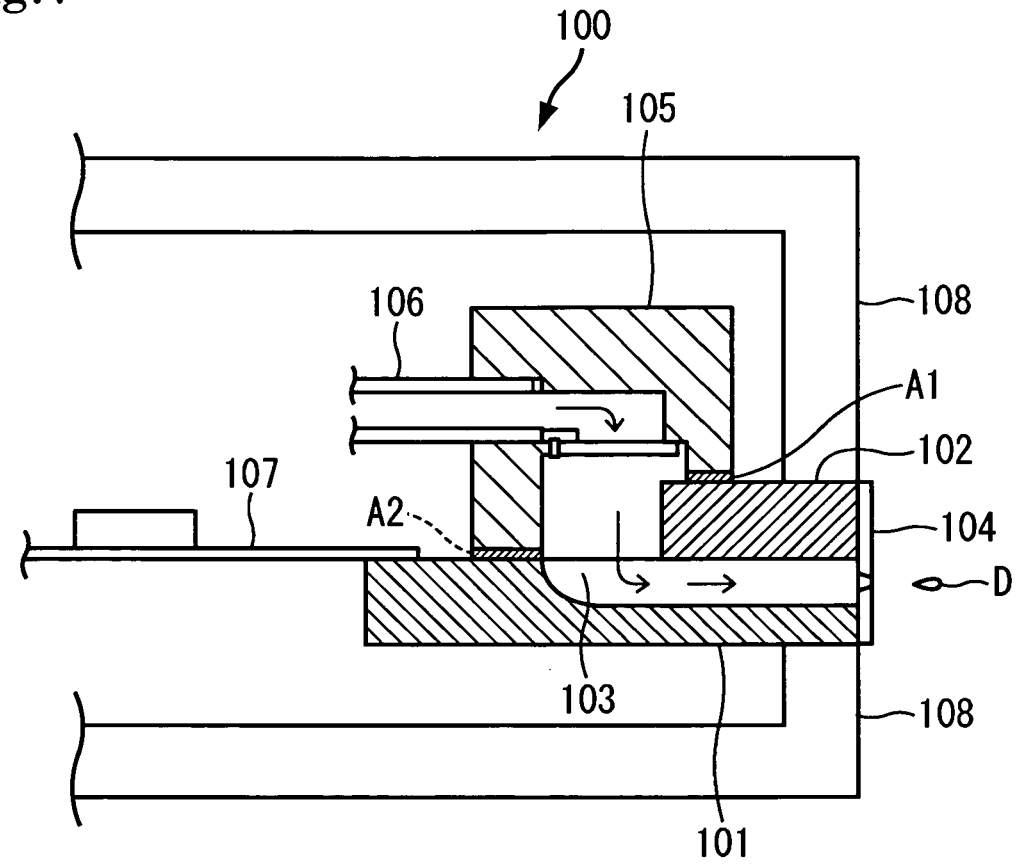
PRIOR ART Fig.7
FIG. 7 is a sectional view of a conventionally known ink jet head.

FIG. 6 is a schematic perspective view of a liquid jet apparatus 20 according to a fifth embodiment of the present invention.

The liquid jet apparatus 20 includes a moving mechanism 33 for reciprocating liquid jet heads 1 and 1', liquid supply tubes 23 and 23' for supplying liquid to the liquid jet heads 1 and 1', and liquid tanks 21 and 21' for supplying liquid to the liquid supply tubes 23 and 23'. Each of the liquid jet heads 1 and 1' includes an actuator for discharging liquid through nozzles which communicate to long grooves, respectively, formed on a surface of a substrate, a flow path member for supplying liquid to the grooves of the actuator, and a damper member provided between the actuator and the flow path member, for coupling the actuator and the flow path member to each other.

Specific description is made in the following. The liquid jet apparatus 20 includes a pair of transfer means 31 and 32 for transferring a recording medium 24 such as paper in a main scan direction, the liquid jet heads 1 and 1' for discharging liquid toward the recording medium 24, pumps 22 and 22' for pressing liquid stored in liquid tanks 21 and 21' into the liquid supply tubes 23 and 23' for supply, and the moving mechanism 33 for causing the liquid jet head 1 to scan in an auxiliary scan direction which is perpendicular to the main scan direction.

Each of the pair of transfer means 31 and 32 includes a grid roller and a pinch roller which extend in the auxiliary scan direction and which rotate with roller surfaces thereof being in contact with each other. A motor (not shown) axially rotates the grid rollers and the pinch rollers to transfer in the main scan direction the recording medium 24 sandwiched therebetween. The moving mechanism 33 includes a pair of guide rails 26 and 27 which extend in the auxiliary scan direction, a carriage unit 28 which is slidable along the pair of guide rails 26 and 27, an endless belt 29 which is coupled to the carriage unit 28, for moving the carriage unit 28 in the auxiliary scan direction, and a motor 30 for rotating the endless belt 29 via a pulley (not shown).

The carriage unit 28 has the plurality of liquid jet heads 1 and 1' mounted thereon for discharging, for example, four kinds of liquid droplets: yellow; magenta; cyan; and black. The liquid tanks 21 and 21' store liquid of corresponding colors, and supply the liquid via the pumps 22 and 22' and the liquid supply tubes 23 and 23' to the liquid jet heads 1 and 1'. The respective liquid jet heads 1 and 1' discharge liquid droplets of the respective colors according to a drive signal. By controlling discharge timing of liquid from the liquid jet heads 1 and 1', rotation of the motor 30 for driving the carriage unit 28, and transfer speed of the recording medium 24, an arbitrary pattern may be recorded on the recording medium 24.

With the structure described above, variations in the discharge speed of liquid discharged from the liquid jet head 1 are reduced, and thus, the liquid jet apparatus 20 which may perform recording on the recording medium with high precision and at high density may be provided.

A structure according to the present invention in which a damper member is used for a bonding portion when a member is bonded to an actuator is described in the above. Characteristics of the damper member are described in more detail in the following.

For example, it is preferred that the damper member (at least one of the above-mentioned first damper member, second damper member, and third damper member) have an average thickness of 0.2 mm to 2.0 mm. When the size is in this range, the damping function may be maintained and the present invention may be carried out without making larger the liquid jet head.

Further, it is preferred that the damper member (at least one of the above-mentioned first damper member, second damper member, and third damper member) be resistant to a solvent or to oil. The damper member is provided at a position at which the damper member is in contact with liquid. When the liquid contains a solvent, if the damper member is resistant to the solvent, the present invention may be carried out without corrosion of the damper member. Further, similarly, when the liquid contains oil, if the damper member is resistant to oil, the present invention may be carried out without corrosion of the damper member.

What is claimed is:

1. A liquid jet head, comprising:

an actuator having a plurality of long grooves arranged on a surface of a substrate, the actuator being configured to discharge liquid from nozzles communicating with respective ones of the plurality of long grooves;

a flow path member for supplying the liquid to the plurality of long grooves of the actuator; and a damper member provided between the actuator and the flow path member for coupling the actuator and the flow path member to each other, the damper member being bonded with an adhesive to each of the actuator and the flow path member.

2. A liquid jet head according to claim 1; wherein the damper member comprises a rubber member.

3. A liquid jet head according to claim 1; wherein the damper member comprises an elastomer member.

4. A liquid jet head according to claim 1; wherein the damper member comprises a first damper member; and further comprising: a base member for supporting the actuator; and a second damper member provided between the base member and the actuator for coupling the base member and the actuator to each other.

5. A liquid jet head according to claim 4; wherein:

the actuator comprises a first actuator and a second actuator stacked together; and the liquid jet head further comprises a third damper member provided between the first actuator and the second actuator for coupling the first actuator and the second actuator to each other.

6. A liquid jet head according to claim 5; wherein the third damper member is provided between a rear surface of a substrate of the first actuator and a rear surface of a substrate of the second actuator.

7. A liquid jet head according to claim 5; wherein:

the actuator further comprises a cover plate stacked on the surface of the substrate so as to block openings of the plurality of long grooves except for a part of the plurality of long grooves; and the third damper member is provided between a rear surface of a substrate of the first actuator and a cover plate of the second actuator.

8. A liquid jet head according to claim 1; wherein the damper member has an average thickness of 0.2 mm to 2.0 mm.

9. A liquid jet head according to claim 1; wherein the damper member is resistant to a solvent.

10. A liquid jet head according to claim 1; wherein the damper member is resistant to oil.

11. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

12. A liquid jet head according to claim 1; wherein the damper member is made of a material resistant to ink.

13. A liquid jet head according to claim 12; wherein the damper member is made of one of a polyethylene rubber material and a polypyrene rubber material.

14. A liquid jet head according to claim 12; wherein each of the damper member and the adhesive is resistant to ink.

15. A liquid jet head according to claim 14; wherein the adhesive comprises an epoxy adhesive.

16. A liquid jet head according to claim 4; wherein the second damper member is made of a material resistant to ink.

17. An ink jet head comprising:

an actuator having a plurality of grooves arranged on a surface of a substrate and being configured to discharge ink from nozzles communicating with respective ones of the plurality of grooves;

a flow path member connected to the actuator for supplying ink to the plurality of grooves of the actuator; and a damper member disposed between the actuator and the flow path member for preventing propagation to the flow path member of vibrations generated during discharge of ink by the actuator, the damper member being bonded with an adhesive to each of the actuator and the flow path member.

18. An ink jet head according to claim 17; wherein each of the damper member and the adhesive is made of a material resistant to the ink.

19. An ink jet head according to claim 18; wherein the damper member is made of one of a polyethylene rubber material and a polypyrene rubber material; and wherein the adhesive comprises an epoxy adhesive.

20. An ink jet apparatus comprising:

an ink jet head according to claim 17;

a moving mechanism for reciprocating the ink jet head;

a ink supply tube for supplying ink to the ink jet head; and an ink tank for supplying the ink to the ink supply tube.

* * * * *